United States Patent [19]

Hanson

[11] 4,119,249

[45] Oct. 10, 1978

[54] ARTICLE CARRIER

[76] Inventor: Horacio Lou Hanson, Diego Rivera 8, Circuito Pintores, Ciudad Satelite, Mexico

[21] Appl. No.: 789,994

[22] Filed: Apr. 22, 1977

[30] Foreign Application Priority Data

Aug. 30, 1976 [MX] Mexico ..... 166083

[51] Int. Cl.[2] ..... A45C 11/00

[52] U.S. Cl. ..... 224/26 R

[58] Field of Search ..... 150/35, 37, 38; 206/259, 260; 224/2 B, 2 D, 2 E, 5 R, 5 A, 5 C, 5 Q, 13, 17, 21-23, 26 R, 26 B, 26 C, 26 D, 26 H

[56] References Cited

U.S. PATENT DOCUMENTS

| | | | |
|---|---|---|---|
| 1,575,420 | 3/1926 | Eisenstark et al. | 206/260 X |
| 2,435,826 | 2/1948 | Greene | 206/259 |
| 2,624,454 | 1/1953 | Korenman | 206/260 X |
| 2,642,912 | 6/1953 | Berger | 150/38 |
| 2,818,969 | 1/1958 | Klein | 206/259 |
| 3,949,916 | 4/1976 | Yount | 224/26 R |
| 4,047,650 | 9/1977 | Domingos | 224/2 B |

*Primary Examiner*—Stephen G. Kunin
*Attorney, Agent, or Firm*—Craig & Antonelli

[57] ABSTRACT

An article carrier which includes a first member having a generally rectangular main body portion having spaced lateral edges and a bottom edge and a second member mounted on said first member and joined along each of the lateral edges of the first member and the bottom edge thereof. An additional joint is provided at a portion intermediate the lateral edges of the first member so as to result in the formation of two individual article receiving compartments, each of which includes a pair of spaced side walls and a front wall interconnecting the side walls. The first member includes two individual cover members, one of which is associated with a respective article receiving compartment for selectively opening and closing the associated article receiving compartment with at least one pleat or projecting rib being provided along the width of at least one of the cover members for enabling a proper closure of the associated article receiving compartment regardless of the contents therein.

30 Claims, 3 Drawing Figures

ARTICLE CARRIER

The present invention relates to a carrier arrangement and, more particularly, to an article carrier arrangement which is attachable to a belt or the like of a user and which provides sufficient space for carrying a diary, checkbook, credit cards, driver's license, credentials, combs, various pens and/or pencils, slide rules, calculators or the like.

In view of the requirements of modern life, individuals are compelled to carry a number of documents which are necessary for their day-to-day activities as well as small objects for personal use which, when taken together, occupy a considerable space within the pockets of the user's clothing so as to cause unsightly bulges.

Morevover, in present day fashions, there is a lack of an adequate number of pockets, particularly in casual clothes, and as a result thereof, purses or tote bags have become popular and necessary to carry the required documents and/or personal objects.

Disadvantages of the use of tote bags or purses reside in the fact that such use is impractical since a certain freedom of movement is not permitted and also there exists the possibility of inadvertent loss or easy theft of the bag.

Several article carrier arrangements have been proposed, for example, in U.S. Pat. Nos. 597,034; 946,028; 1,281,299; and 2,850,152, wherein either a single or multiple compartment carrier arrangement is provided for holding memoranda pads, pencils, eyeglasses or the like.

One disadvantage of the above-mentioned proposed arrangements resides in the fact that, by virtue of their respective constructions, the articles carried therein are not securely maintained. Moreover, such devices do not lend themselves to carrying important items such as, for example, credit cards, a driver's license, a checkbook, or the like.

To provide for more security in article carrying devices, in U.S. Pat. No. 1,895,074, it is proposed to provide separate compartments for a pen, pencil and notepad, with a single cover member being provided for covering the individual compartments. The single cover member is divided into several flaps which are individually secured by snap fasteners.

While the last-mentioned carrying device provides some security and aids in maintaining the articles in the device, the construction of the compartments and cover member are such that the nature and number of articles which can be arranged in the carrying device is strictly limited.

Other article carrying devices are proposed, for example, in U.S. Pat. Nos. 668,466; 1,135,833; 1,648,565; and 3,854,639; however, these proposed carrying devices are designed and constructed so as to accommodate specific items and, as such, do not readily lend themselves to carrying important documents and small personal objects in a convenient manner.

Furthermore, belt constructions for money and personal papers have been proposed, for example, In U.S. Pat. No. 2,383,748; however, such belts have met with limited acceptance by virtue of the fact that access to the compartments to obtain a document or the like is difficult and the belt is somewhat uncomfortable to wear.

The aim underlying the present invention essentially resides in providing an improved article carrier arrangement which is not only convenient to carry, but also provides for securely maintaining the respective articles in the carrying while permitting simple access to the carrier by the user of the carrier arrangement.

The underlying problems are solved in accordance with the present invention by providing an article carrier arrangement such as, for example, a wallet which can be attached to a belt or the like of the user and which occupies a minimum of space without getting in the way of the user while at the same time being maintained close to the body of the user and also providing sufficient space to carry a diary, checkbook, a number of credit cards, a license, credentials, a comb, various pens and/or pencils, a slide rule, a calculator, etc.

According to one feature of the present invention, at least two individual compartments are formed on a single backing member with the individual compartments being formed by a single member secured along the lateral and bottom edges of the backing member and at least along a portion of the backing member intermediate the lateral edges thereof.

Preferably, according to another feature of the present invention, the backing member terminates in two individual cover members which securely close the respective compartments to maintain the articles therein. The cover members are coordinated to the respective openings of the compartments and at least one of the cover members is constructed so as to be adjustable, thereby permitting the accommodation of items having a height greater than the height of the associated compartment.

According to still another feature of the present invention, means are provided for enabling a proper closure of the respective cover members, regardless of whether the compartment is very full or empty. Preferably, such means include at least one contact sensitive fastening means arranged on the cover members and/or the front walls of the article receiving compartments.

Moreover, according to the present invention, the back wall is provided with spaced grooves defining mounting straps with each of the grooves, on an outwardly pointing side thereof, having a predetermined configuration so as to facilitate easy introduction and removal from the belt of the user.

According to a still further feature of the present invention, at least one of the compartments is provided with a configured edge portion along at least one wall thereof to facilitate the insertion and removal of pens and/or pencils.

Additionally, according to the present invention, independent walls are provided between the at least two compartments with but a single joint arranged between the independent walls, whereby the article carrier arrangement can be bent without causing a deformation of the individual compartments.

Accordingly, it is an object of the present invention to provide an article carrying arrangement which avoids, by simple means, the shortcomings and drawbacks encountered in the prior art.

Another object of the present invention resides in providing an article carrying arrangement which is simple in construction and, therefore, relatively inexpensive to manufacture.

Yet another object of the present invention resides in providing a carrying arrangement which may be conveniently mounted on a belt or the like of the user and which ensures a secure maintenance of the articles therein while nevertheless permitting the user to obtain access to the article in a simple manner.

These and other objects, features and advantages of the present invention will become more apparent from the following description when taken in connection with the accompanying drawing, which shows, for the purposes of illustration only, one embodiment in accordance with the present invention, and wherein.

Figure 1:
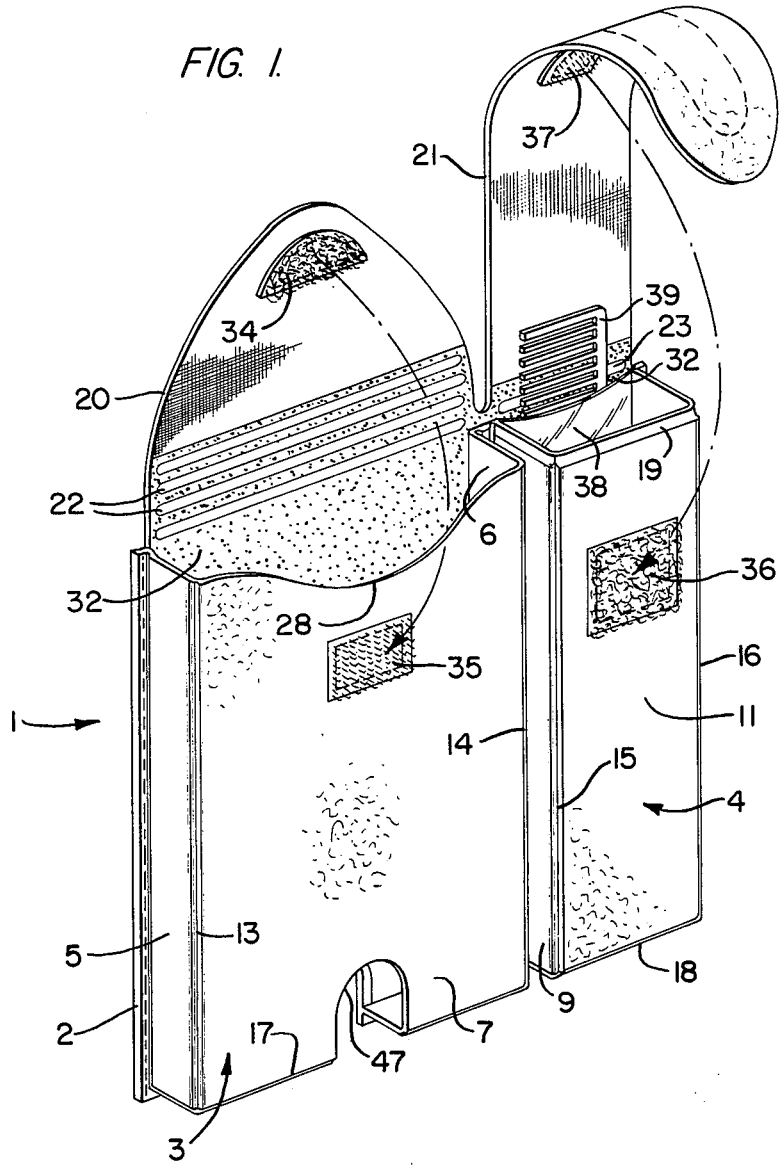
FIG. 1 is a frontal perspective view of an article carrying arrangement in accordance with the present invention.

Referring now to the drawings wherein like reference numerals are used through the various views to designate like parts and, more particularly, to FIG. 1, according to this figure, an article carrying device generally designated by the reference numeral 1 is provided with at least two individual compartments generally designated by the reference numerals 3 and 4.

The compartments 3, 4 are formed from a single member with the compartment 3 including a pair of spaced side walls 5, 6, a front wall 7 and a bottom wall 8, and with the compartment 4 including spaced side walls 9, 10, a front wall 11 and bottom wall 12.

To facilitate the forming of the compartments 3, 4 and also to provide flexibility of the respective compartments, grooves or predetermined folding lines 13, 14 and 15, 16 are provided between the respective front walls 7, 11 and associated side walls 5, 6 and 9, 10 with similar grooves or folding lines 17, 18 being arranged between the respective front walls 7, 11 and bottom walls 8, 12.

The compartment 3 may be provided with a semi-circular opening 47 which permits access to the interior of the compartment so that a finger of the user may be inserted into the opening 47 and moved upward in order that the contents in the compartment 3 may be lifted and easily removed. Additionally, to facilitate the drawing out of the contents of the compartment 3, the upper edge of the front wall 7 may be provided with a cutout portion 28 having a V-shape or the like, thereby making it easy for the fingers of the user to contact the objects within the compartment 3.

The compartment 4 is provided along its upper edge with a bevelled portion 19 which is constructed so as to facilitate the accommodation of pens and/or pencils, with the bevelled portion 19 causing a displacement of the clips conventionally provided on pens and/or pencils outwardly away from the front wall 11.

Figure 2:
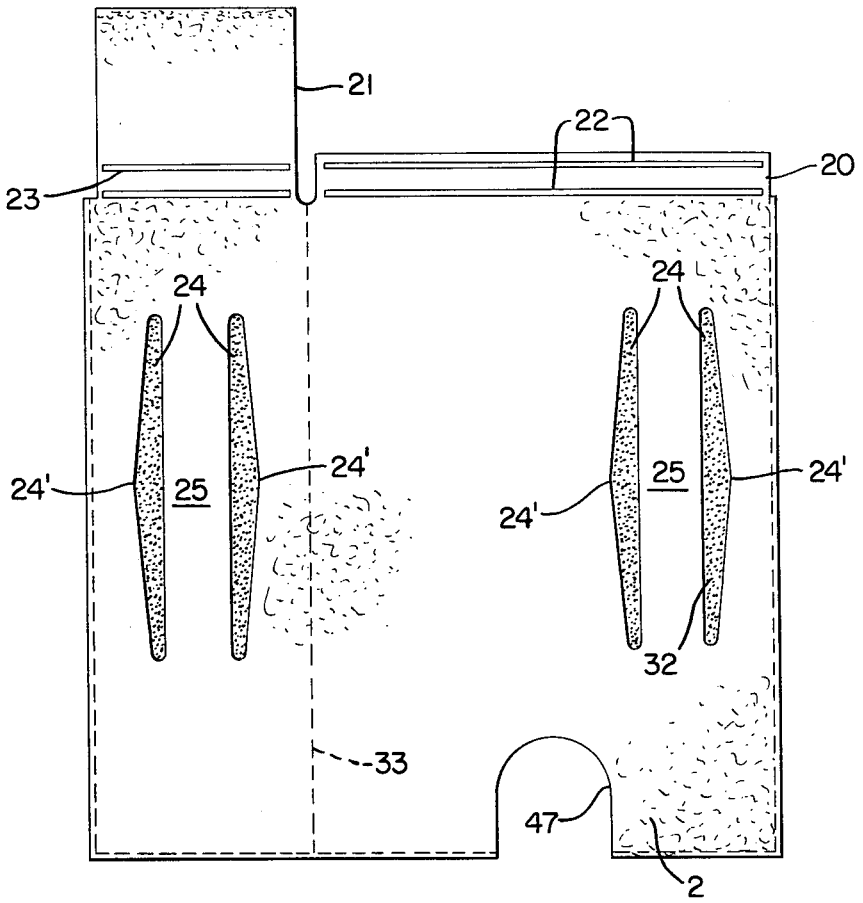
FIG. 2 is a rear plan view of the article carrying arrangement of FIG. 1.

As shown most clearly in FIG. 2, the single member forming the compartments 3, 4 is mounted on a back wall 2 which has a generally rectangular main body portion in which are provided two pairs of spaced elongated grooves or slots 24 with each pair of grooves defining a belt mounting strap 25. Preferably, each of the grooves 24 has, at a side pointing outwardly, a slightly curved portion 24' to permit easy introduction and removal of the belt which is accommodated between the straps 25 and an inner lining 32 provided on the back wall 2. The upper edge of the back wall 2 terminates in two individual cover members 20, 21 which are adapted to selectively open and close the compartments 3, 4.

Figure 3:
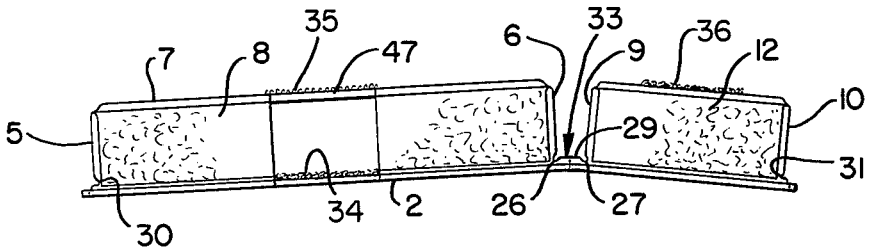
FIG. 3 is a bottom view of the article carrying arrangement of FIG. 1.

As shown in FIGS. 1 and 3, the side walls 5, 10 are joined to the side edges of the back wall 2 along their entire lengths with the bottom walls 8, 12 being joined along the lower edge of the back wall 2 and, as shown most clearly in FIG. 3, a single joint 33 is formed between the side walls 6 and 9 of the compartments 3, 4.

Since there are independent walls between the compartments 3, 4 and there is but a single joint 33 joining the front member forming the compartments 3, 4 to the back wall 2, it is possible for the back wall 2 to be bent without the compartments 3, 4 being deformed and, in such case, the carrying device 1 would assume the shape illustrated in FIG. 3 with portions of the back wall 2 of the respective compartments 3, 4 remaining substantially planar.

To further facilitate the bending of the carrying device 1 without deformation of the respective compartments 3, 4, groves or fold lines 26, 27 are provided along the inner edges of the side walls 6, 9 with a raised rib portion 29 being arranged between the grooves 26, 27, along which rib portion 29, the front member is joined to the back wall 2 by the single joint 33.

Likewise, grooves or fold lines 30, 31 are provided at the inner ends of the side walls 5, 10 to facilitate the joining of the walls 5, 10 to the side edges of the back wall 2 and also assure flexibility of the compartments 3, 4.

While the drawings illustrate the joining of the front member to the back wall 2 by stitching, it is understood that other methods of joining the members are also possible, depending on the nature of the material of the carrying device 1. Thus, for example, the joining of the members to form the carrying device may be accomplished by applying a suitable glue or adhesive, by using solvent cementing or thermal welding along the edges of the side walls 5, 10 and between the rib portion 29 and back wall 2.

As shown in FIG. 1, the cover member 20 has a shape corresponding to the upper edge of the compartment 3 which enables the cover member 20 to duly cover the space defined by the cutout portion 28. Additionally, a series of pleats or raised portions 22 are provided along the width of the cover member 20 so as to prevent flairing of the outside edges by providing a degree of rigidity to the cover member 20. The cover member 20 is provided with a strip or portion 34 of "Velcro" which cooperates with a further strip or portion 35 of "Velcro" provided on the front wall 7 of the compartment 3 to firmly maintain the cover member 20 in a closed position whether the compartment 3 is very full or empty, thereby ensuring that the contents of the compartment 3 do not accidentally fall out, as well as providing a measure of security against pickpocketing.

Since pens, pencils, slide rules or the like can vary in height and extend above the upper edge of the compartment 4, it is necessary to provide a cover member which can be adjusted to the required height so as to maintain the items securely in the compartment 4. For this purpose, the cover member 21 is fashioned as a strap having a length which is relatively long in comparison with the depth of the opening of the compartment 4 so that the cover member 21 can be closed by making contact with the top edge of the compartment 4 or raised to accommodate items extending above the top edge of such compartment.

The cover member 21 is provided with a strip 37 of "Velcro" which cooperates with a further strip 36 of "Velcro" provided on the front wall 11 of the compartment 4 to maintain the cover member 21 in a closed position regardless of the length of average pens, pencils, etc., ensuring also that the contents of the compartment 4 do not accidentally fall out, as well as providing a measure of security against pickpocketing.

As with the cover member 20, at least one or a plurality of pleats or raised portions 23 are provided along the width of the cover member 21 to prevent flairing of the outside edges by providing a degree of rigidity to the cover member 21.

Preferably, the inner lining 32 is provided along the entire main body portion of the back wall 2 and extends upwardly at least to the extent of the series of pleats 23 provided at the cover members 20, 21, respectively.

The compartment 4 may be provided with an additional lining or wall member 38 which defines between an inner surface thereof and an outer surface of the inner lining 32 a compartment for accommodating, for example, a comb 39 or the like.

The article carrying device may be constructed of leather, plastic, or other suitable material and, for example, the compartment 3 may be approximately 8 centimeters wide, 11 centimeters high, and 2 5/10 centimeters deep, with the compartment 4 being of the same height and depth, but only approximately 3 centimeters in width.

While I have shown and described only one embodiment in accordance with the present invention, it is understood that the same is not limited thereto, but is susceptible of numerous changes and modifications as known to a person skilled in the art, and I therefor do not wish to be limited to the details shown and described herein, but intend to cover all such changes and modifications as are encompassed by the scope of the appended claims.

I claim:

1. An article carrier comprising:

a first member having a generally rectangular main body portion including two spaced lateral edges and a bottom edge, a second member, means for joining said second member to said first member along each of said spaced lateral edges, along said bottom edge and along at least a portion of the first member intermediate said spaced lateral edges so as to define two individual article receiving compartments, each of said article receiving compartments including a pair of spaced side walls, a front wall interconnecting said side walls and a bottom wall, said joining means intermediate said spaced lateral edges of said first member being disposed between adjacent side walls of said at least two individual article receiving compartments so as to permit deformation of the first member without deforming the individual article receiving compartments, said first member further including two individual cover members, each of said cover members being associated with a respective article receiving compartment for selectively opening and closing the associated article receiving compartment.

means formed in said first member at least in a fold area of at least one of said cover members for preventing flairing of edges of said cover members, said flairing preventing means extending along the width of said at least one cover member, and means provided in at least one of said compartments for permitting across to the articls contained therein and facilitating removal of the articles therefrom.

2. The carrier of claim 1, wherein said means for preventing flairing of edges of said cover members comprises a plurality of pleats formed in said first member and extending along the width of said at least one cover member.

3. The carrier of claim 2, wherein said means for permitting access includes an opening provided along a bottom edge of said at least one article receiving compartment.

4. The carrier of claim 3, wherein said opening has a semi-circular configuration.

5. The carrier of claim 4, wherein one of said article receiving compartments is provided with a cutout portion along a top edge of the front wall thereof to facilitate removal of articles therefrom and the cover member associated with said last-mentioned article receiving compartment has a configuration matching said cutout portion.

6. The carrier of claim 1, wherein said at least two articles receiving compartments have different widths, and wherein the cover member associated with the article receiving compartment having a smaller width is constructed as a strap having a length which is larger than an opening of the article receiving compartment so as to permit said last-mentioned cover member to adjust to heights of articles contained in the article receiving compartment.

7. The carrier of claim 1, wherein one of the article receiving compartments is provided with a bevelled edge along a top edge of its front wall.

8. The carrier of claim 7, further comprising contact sensitive fastening means arranged on the cover members and front walls of the article receiving compartments for securely fastening said cover members to the associated front wall in a closed position, regardless of the number of articles accommodated in one of the article receiving compartments and height of the articles contained in the other article receiving compartment.

9. The carrier of claim 8, wherein the other of the article receiving compartments is provided with a cutout portion along a top edge thereof to facilitate removal of articles therefrom.

10. The carrier of claim 7, further comprising a liner means provided along the main body portion of the first member.

11. The carrier of claim 10, wherein said liner means extends from approximately the bottom of said first member to approximately the means for preventing flairing.

12. The carrier of claim 10, further comprising an additional linear means arranged in one of the article receiving compartments for defining an additional article receiving compartment therein.

13. An article carrier comprising:

a first member having a generally rectangular main body portion including two spaced lateral edges and a bottom edge, a second member, means for joining said second member to said first member along each of said spaced lateral edges, along said bottom edge and along at least a portion of the first member intermediate said spaced lateral edges so as to define two individual article receiving compartments, each of the article receiving compartments including a pair of spaced side walls and a front wall interconnecting said side walls, said joining means intermediate said spaced lateral edges of said first member being disposed between adjacent side walls of said at least two individual receiving compartments so as to permit deformation of the first member without deforming the individual article receiving compartments, said first member further including two individual cover members, each of said cover members being associated with a respective article receiving compartment for selectively opening and closing the associated article receiving compartment, means provided along the width of at least one of said cover members for preventing flairing of edges of said cover members including a plurality of pleats extending along the entire width of said at least one cover member, means provided in at least one of said compartments for permitting access to the articles contained therein and facilitating removal of the articles therefrom including an opening provided along a bottom edge of said at least one article receiving compartment, said opening having a semi-circular configuration, a cutout portion provided along a top edge of the front wall of one of the article receiving compartments for facilitating removal of articles therefrom, the cover member associated with said last-mentioned article receiving compartment having a configuration matching said cutout portion, and the other of said article receiving compartments provided with a bevelled edge along a top edge of its front wall.

14. The carrier of claim 13, wherein said at least two article receiving compartments have different widths, and wherein the cover member associated with the article receiving compartment having a smaller width is constructed as a strap having a length which is larger than an opening of the article receiving compartment so as to permit said last-mentioned cover member to adjust to heights of articles contained in the article receiving compartment.

15. The carrier of claim 14, further comprising a liner means arranged in the article receiving compartment having the smaller width for defining an additional article receiving compartment therein.

16. The carrier of claim 15, further comprising contact sensitive fastening means arranged on the cover members and front walls of the article receiving compartments for securely fastening said cover members to the associated front wall in a closed position, regardless of the number of articles accommodated in one of the article receiving compartments and height of the articles contained in the other article receiving compartment.

17. The carrier of claim 16, wherein at least two pairs of spaced grooves are provided on said first member on a side thereof opposite the side upon which said second member is joined thereto, each pair of spaced grooves defining therebetween a mounting strap for mounting the article carrier to a belt means.

18. The carrier of claim 17, wherein each of said grooves includes one side edge having a curved indentation for facilitating the introduction and removal of a belt means.

19. The carrier of claim 18, wherein said joining means between adjacent side walls of the at least two individual article receiving compartments includes a projecting rib portion, and wherein said last-mentioned side walls include a groove means adjoining said projecting rib portion to facilitate bending of the article carrier without deformation of the respective article receiving compartments.

20. The carrier of claim 19, wherein further groove means are provided between each front wall and associated side walls and bottom walls for facilitating formation of the individual article receiving compartments and for providing flexibility thereof without deformation of the respective walls.

21. The carrier of claim 20, wherein additional groove means are provided in the side walls adjoining the respective lateral edges of the first member for facilitating the joining of said second member to said first member at said lateral edges.

22. An article carrier comprising:

a first member having a generally rectangular main body portion including two spaced lateral edges and a bottom edge, a second member, means for joining said second member to said first member along each of said spaced lateral edges, along said bottom edge and along at least a portion of the first member intermediate said spaced lateral edges so as to define at least two article receiving compartments having different widths, each of the article receiving compartments including a pair of spaced side walls and a front wall interconnecting said side walls, said joining means intermediate said spaced lateral edges of said first member being disposed between adjacent side walls of said at least two individual article receiving compartments so as to permit deformation of the first member without deforming the individual article receiving compartments, said first member further including two individual cover members, each of said cover members being associated with a respective article receiving compartment for selectively opening and closing the associated article receiving compartment, the cover member associated with the article receiving compartment having a smaller width is constructed as a strap having a length which is larger than an opening of the article receiving compartment so as to permit said last-mentioned cover member to adjust to heights of articles contained in the article receiving compartment, the article receiving compartment having the smaller width provided with a bevelled edge along a top edge of its front wall, means provided along the width of at least one of said cover members for preventing flairing of edges of said cover memers, and means provided in at least one of the compartments for permitting access to the articles contained therein and facilitating removal of the articles therefrom.

23. The carrier of claim 22, further comprising contact sensitive fastening means arranged on the cover members and front walls of the article receiving compartments for securely fastening said cover members to the associated front wall in a closed position, regardless of the number of articles accommodated in one of the article receiving compartments and height of the articles contained in the other articles receiving compartment.

24. The carrier of claim 23, further comprising a liner means arranged in the article receiving compartment having the smaller width for defining an additional article receiving compartment therein.

25. The carrier of claim 24, wherein said joining means between adjacent side walls of the at least two individual article receiving compartments includes a projecting rib portion, and wherein said last-mentioned side walls include a groove means adjoining said projecting rib portion to facilitate bending of the article carrier without deformation of the respective article receiving compartments.

26. The carrier of claim 25, wherein further groove means are provided between each front wall and associated side walls and bottom walls for facilitating formation of the individual article receiving compartments and for providing flexibility thereof without deformation of the respective walls.

27. The carrier of claim 26, wherein additional groove means are provided in the side walls adjoining the respective lateral edges of the first member for facilitating the joining of said first member to said second member at said lateral edges.

28. An article carrier comprising:

a first member having a generally rectangular main body portion including two spaced lateral edges and a bottom edge, a second member, means for joining said second member to said first member along each of said spaced lateral edges, along said bottom edge and along at least a portion of the first member intermediate said spaced lateral edges so as to define at least two individual article receiving compartments, each of the article receiving compartments including a pair of spaced side walls, a front wall interconnecting said side walls and a bottom wall, said joining means intermediate said spaced lateral edges of said first member being disposed between adjacent side walls of said at least two individual article receiving compartments so as to permit deformation of the first member without deforming the individual article receiving compartments, said first member further including two individual cover members, each of said cover members being associated with a respective article receiving compartment for selectively opening and closing the article receiving compartment, said joining means between adjacent side walls of the at least two individual article receiving compartments including a projecting rib portion, said last-mentioned side walls including a groove means adjoining said projectng rib portion to facilitate bending of the article carrier without deformation of the respective article receiving compartments, means provided along the width of at least one of said cover members for preventing flairing of edges of said cover members, and means provided in at least one of said compartments for permitting access to the articles contained therein and facilitating removal of the articles therefrom.

29. The carrier of claim 28, wherein further groove means are provided between each front wall and associated side walls and bottom walls for facilitating formation of the individual article receiving compartments and for providing flexibility thereof without deformation of the respective walls.

30. The carrier of claim 29, wherein additional groove means are provided in the side walls adjoining the respective lateral edges of the first member for facilitating the joining of said first member to said second member at said lateral edges.

* * * * *